US006066999A

United States Patent [19]

Pischinger

[11] Patent Number: 6,066,999

[45] Date of Patent: May 23, 2000

[54] ELECTROMAGNETIC ACTUATOR HAVING MAGNETIC IMPACT-DAMPING MEANS

[75] Inventor: Martin Pischinger, Aachen, Germany

[73] Assignee: FEV Motorentechnik GmbH & Co. KG, Aachen, Germany

[21] Appl. No.: 09/032,918

[22] Filed: Mar. 2, 1998

[30] Foreign Application Priority Data

Feb. 28, 1997 [DE] Germany ..... 297 03 585 U

[51] Int. Cl.[7] ..... H01H 47/18; H01F 7/08

[52] U.S. Cl. ..... 335/266; 335/226; 335/245; 335/256; 335/257; 361/210

[58] Field of Search ..... 335/226, 245, 335/256, 257, 266; 123/90.11; 361/210, 180

[56] References Cited

U.S. PATENT DOCUMENTS 4,229,775 10/1980 Miller ..... 361/210

*Primary Examiner*—M. L. Gellner
*Assistant Examiner*—Raymond Barrera
*Attorney, Agent, or Firm*—Venable; Gabor J. Kelemen

[57] ABSTRACT

An electromagnetic actuator includes an electromagnet having a yoke and an operating coil supported by the yoke and connectable to a controllable current supply for effecting a current flow through said operating coil. An armature is movable from a first position remote from the pole face of the electromagnet to a second, pole face-engaging position in response to a first electromagnetic force generated by a current flow through the operating coil. A resetting spring is coupled to the armature and opposes the first electromagnetic force. Further, a circuit is provided which is formed of a braking coil supported by the yoke and a switching element having open and closed states. The circuit is closed in the closed state of the switching element and is in the open state of the switching element. Also, a switch control arrangement is provided which is responsive at least indirectly to a distance of the armature from the pole face during motion of the armature toward the pole face for placing the switching element into its closed state when the armature is at a given distance from the pole face, whereby the circuit is closed for producing a second electromagnetic force opposing the first electromagnetic force.

4 Claims, 2 Drawing Sheets

ELECTROMAGNETIC ACTUATOR HAVING MAGNETIC IMPACT-DAMPING MEANS

BACKGROUND OF THE INVENTION

Electromagnetic actuators essentially comprising at least one electromagnet and an armature that is connected to a setting member to be actuated, the armature being movable counter to the force of a restoring spring when the electromagnet is supplied with current, are distinguished by a high switching speed. An associated problem, however, is that the magnetic force acting on the armature increases as the armature more closely approaches the pole surface of the electromagnet, so that the armature impacts the pole surface at high speed. In addition to noise, this can lead to a rebound, that is, the armature initially impacts the pole surface, but then lifts off, at least temporarily, until it finally comes to rest completely. This can impair the function of the control member, which, particularly in actuators having a high switching frequency, can result in considerable interferences.

It is therefore desirable for the impact speeds to be in an order of magnitude of 0.01 to 0.2 m/s. It is crucial that such low impact speeds also be ensured under real operating conditions, with all of the associated stochastic fluctuations. External interfering influences, such as vibrations or the like, can lead to a sudden release in the final approach phase, or after the armature has come to rest on the pole surface.

SUMMARY OF THE INVENTION

It is the object of the invention to guide the armature to its seat on the pole surface at a low speed, but with the provision of a sufficient holding force following the impact of the armature at the pole surface, in an electromagnetic actuator of the aforementioned type.

In accordance with the invention, this object is accomplished with an electromagnetic actuator having at least one electromagnet, at whose yoke an operating coil that is connected to a controllable current supply, and a braking coil, are disposed, the braking coil forming an integrally-closed circuit that can be opened and closed by an actuatable switching element, the actuator further having an armature that is connected to a setting member to be actuated, and which is movably guided, counter to the force of at least one restoring spring, from a first switching position, in the direction of the pole surface of the electromagnet, into a second switching position that is defined by the contact of the armature with the pole surface when the operating coil is supplied with current.

If a change occurs in the magnetic flux in the electromagnet, a voltage is induced in the braking coil. Such a change in the magnetic flux occurs when a preferably constant current flows in the operating coil, and the armature moves either toward or away from the pole surface. The change in the magnetic flux is a function of the armature speed and the distance of the armature from the pole surface when the operating coil is supplied with a constant current; namely, the magnetic flux increases as the armature approaches the pole surface, and decreases as the armature moves away from the pole surface. If the switch in the circuit of the braking magnet is closed, a current that reduces the change in the magnetic flux can flow in the circuit. Because the magnetic flux is a measure for the force exerted on the armature, the force increase can be reduced as a function of the approach speed as the armature approaches the pole surface of the magnet. The smaller the distance between the armature and the pole surface of the magnet, the greater the influence of the armature speed on the change in the flux. This permits the option of reducing the impact speed of the armature at the pole surface, because particularly the speed of the armature in the range of short distances from the pole surface is significant. Because the current in the circuit of the braking coil returns to zero following the impact of the armature, the full magnetic force that is predetermined by the current supply of the operating coil acts in turn, to an increasing extent, as a holding force on the armature. The time from which the counter effect of the braking coil is to act on the armature can be predetermined by a corresponding actuation of the switch in the circuit of the braking coil into the closed position. By switching into the open position, the full holding force of the operating coil can become effective very quickly.

In an advantageous embodiment of the invention, a sensor is provided that detects the approach of the armature toward the pole surface, and is connected to a control device for the switch. A wide variety of sensors can be used in the different function for actuating the switch. Accordingly, suitable sensors include a motion sensor associated with the armature, or a position sensor that detects the passing of the armature and triggers a corresponding control signal for the control device of the switch, for example using electroinductive means. This ensures that the braking coil will be activated by the position of the armature independently of its travel speed.

Means with which the magnitude of the current is detected during current supply of the operating coil are also considered sensors in the scope of the invention. With these means, it is possible to produce the control signal for closing the switch in the circuit of the braking coil at a time when the current supplied to the operating coil is maintained at a constant level shortly before the anticipated time of impact of the armature at the pole surface. At this time, the control signal can also be transmitted to the switch in the circuit of the braking coil. Depending on the application, it can be useful to advance or delay the triggering of this control signal by a certain measure.

DESCRIPTION OF THE PREFERRED EMBODIMENTS

Figure 1:
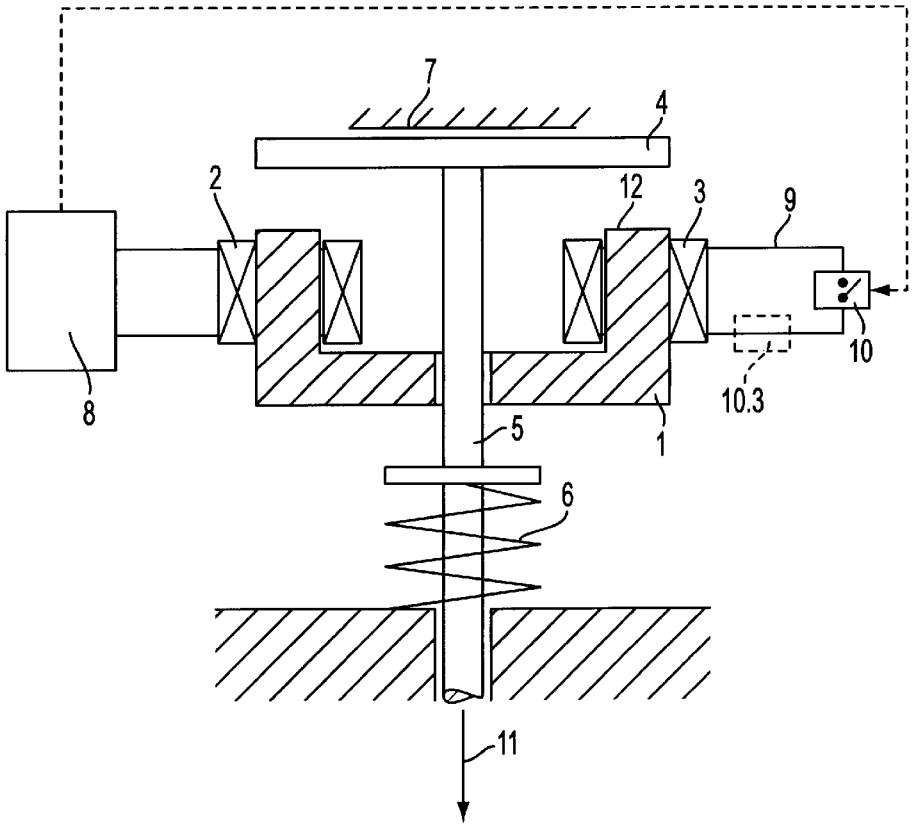
FIG. 1 is a schematic sectional elevation of an electromagnetic actuator according to the invention.

The electromagnetic actuator illustrated in a fundamental outline in FIG. 1 essentially comprises a yoke 1 that is wound with an operating coil 2 and a braking coil 3. The operating coil 2 and braking coil 3 can be wound around the same center, that is, they can be superposed. In the fundamental outline, the two coils are shown separately for clarification.

An armature 4, which is connected by way of a guide rod 5 to a setting member to be actuated, not shown in detail, is associated with the electromagnet comprising the yoke 1 and coils 2 and 3. The armature 4 is held in a first switching position defined by a stop 7 or similar limiting means when the electromagnet is not supplied with current.

The operating coil 2 is connected to a controllable current supply 8, so that the operating coil 2 may be energized or de-energized depending on operational requirements.

The braking coil 3 is connected to an integrally-closed circuit 9 having an actuatable switching element 10. The switch can be a mechanical or electronic switching element or the like, and is connected to the control element of the current supply 8.

If the operating coil 2 is supplied with current, the armature 4 is moved, counter to the force of the restoring spring 6, toward the electromagnet in the direction of arrow 11; at the pole surface 12 of the electromagnet, the armature eventually comes to rest in the second switching position to be attained.

The approach of the armature 4 toward the pole surface 12 of the electromagnet causes the magnetic flux of the system to change, which is particularly evident when the operating coil 2 is acted upon by a constant current. A voltage is generated in the braking coil 3 due to the changing magnetic flux. If, at a certain, predeterminable time, the switching element 10 is closed, a current flows in the circuit 9 of the braking coil 3; this current reduces the force acting on the armature 4 as a function of the distance between the armature 4 and the pole surface and its approach speed. Consequently, the approach speed of the armature 4 toward the pole surface 12 is reduced under the influence of the counter effect of the restoring spring 6, so that the impact speed is reduced with a corresponding design of the braking coil 3 with regard to its circuit 9, in which a load 10.3 may also be disposed. As soon as the armature 4 rests against the pole surface 12, that is, no more changes occur in the magnetic flow, the current flux in the circuit 9 drops to zero, so, that when the current supply of the operating coil 2 is unchanged, the armature 4 is held by the full holding force against the pole surface 12, counter to the restoring force of the spring 6. If the current supply of the operating coil 2 is cut off, the armature 4 moves back into the original switching position.

Figure 2:
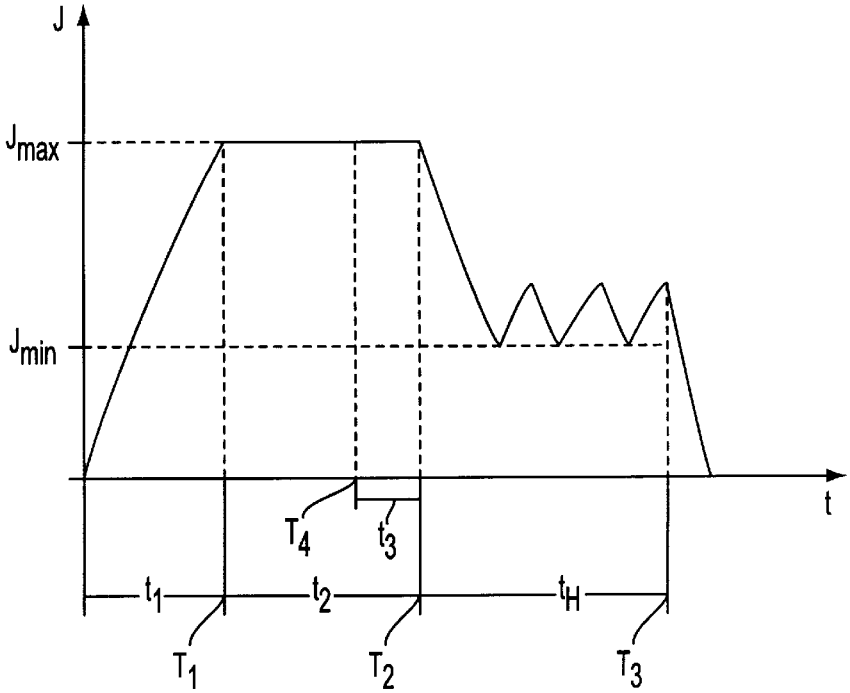
FIG. 2 is a diagram showing the current course in the operating coil.

FIG. 2 schematically shows a course of the current flowing through the operating coil 2 as predetermined by the control of the current supply 8. As is apparent from the diagram, the current increases to a predeterminable level ImaX during a time t1, with the predeterminable maximum current being dimensioned such that the generated magnetic force suffices to move the armature 4, counter to the force of the restoring spring 6, in the direction of the pole surface 12. Because the force acting on the armature 4 increases inversely to the distance from the pole surface 12, from the moment T1 the current to be supplied can be held at a constant level until after a lapse of a predeterminable time t2 to the presumed impact of the armature at the pole surface 12 at moment $T_2$, the armature and the setting member connected thereto are presumed with certainty to have reached the second switching position.

A significantly lower holding force is required for holding the armature 4 in this second switching position over a predeterminable time $t_h$, so that from moment T2, the level of the current supplied to the operating coil 2 is reduced to an amount $I_{min}$ by way of the control of the current supply 8 to save energy. It is known to improve energy savings by cycling the current during the time $t_H$, as shown in the diagram. After the holding period $t_H$ has expired, the current supply to the operating coil 2 is cut off at moment $T_3$, so the armature 4 moves back into its first switching position due to the action of the force of the restoring spring 6.

As can be seen from the diagram, the current supply of the operating coil 2 is already adjusted to the constant current level $I_{maX}$ at a moment when the armature is still moving in the direction of the pole surface 12. Thus, a change occurs in the magnetic flux that is unequivocally dependent on the armature movement and its position with respect to the pole surface 12. If the switching element 10 is now closed by way of a corresponding control signal at a predeterminable moment $T_4$, the braking action of the braking magnet 3 becomes effective due to the change in the magnetic flux over the remaining time $t_4$, which is caused by the approach of the armature 4. The switching element 10 is thus switched on as a function of time, beginning after the current supply of the operating magnet 2 has been switched on.

Figure 3:
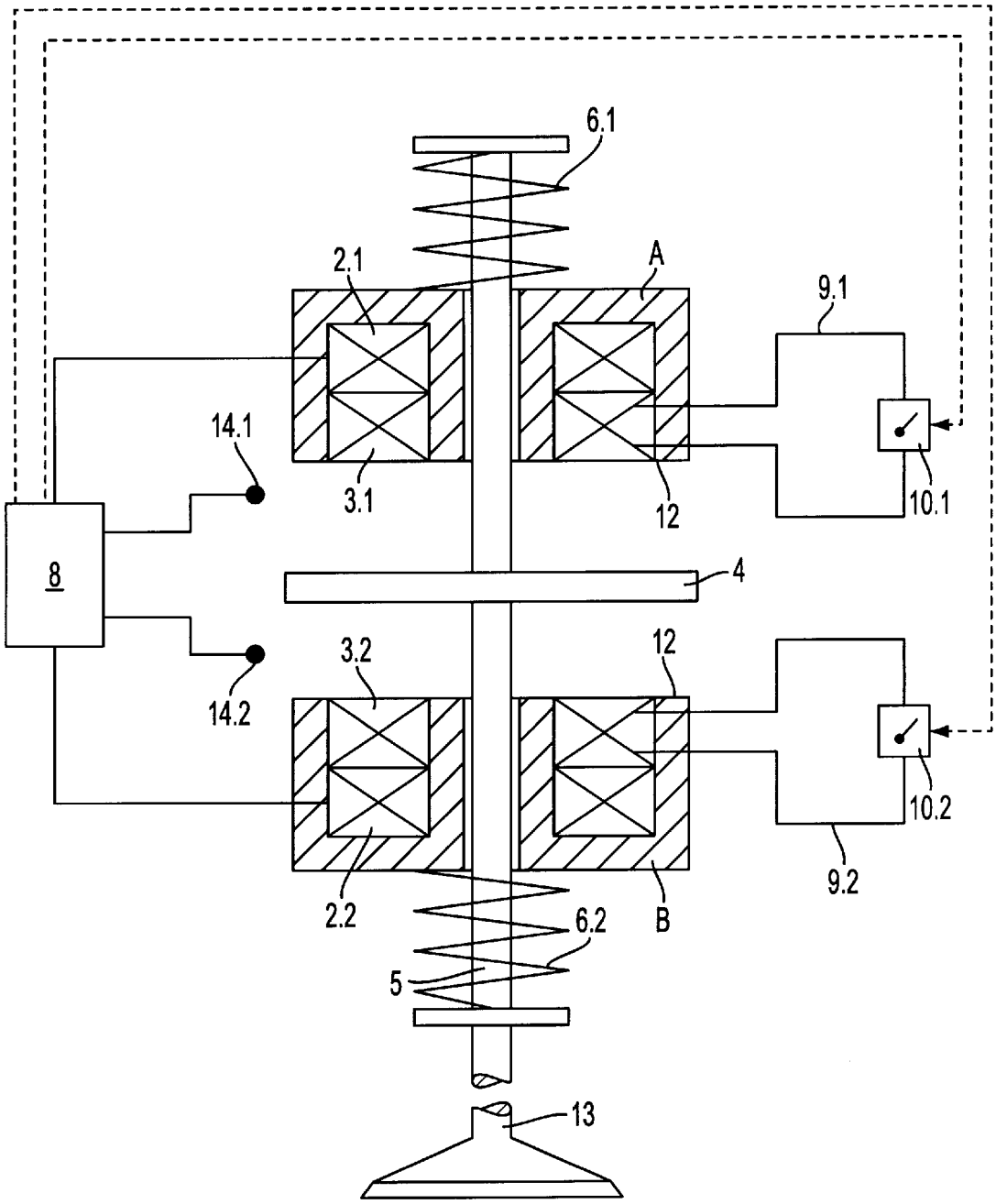
FIG. 3 is a schematic sectional elevation of an embodiment that includes two electromagnets.

FIG. 3 shows a modified embodiment of an electromagnetic actuator, as can be used, for example, for actuating cylinder valves in reciprocating piston engines. The basic design corresponds to the design shown in FIG. 1, with the exception that two electromagnets A and B are disposed with spacing from one another such that their pole faces 12 face one another. An armature 4 is disposed between the two electromagnets A and B to be guided back and forth counter to the force of restoring springs 6.1 and 6.2. If the electromagnets are in a de-energized state, the armature 4 is located in a central position between the two electromagnets A and B, the position being predetermined by the force of the opposing restoring springs. By supplying current alternatingly to the electromagnets A, B, the armature correspondingly rests against the pole surface 12 of the electromagnet A, for example, as the first switching position, and subsequently against the pole surface 12 of the electromagnet B, for example, as the second switching position. Depending on the application, the intermediate position can constitute an additional switching position when the magnets are set de-energized.

A valve stem 13 of a cylinder valve of a reciprocating engine, for example, is connected to the guide rod 5, so that when the armature 4 rests against the electromagnet A, the valve is held in its closed position, and when the armature rests against the electromagnet B, the valve is held in its open position. The restoring spring 6.2 acts as a valve opening spring, while the restoring spring 6.1 acts as a valve closing spring.

The operating coils 2.1 and 2.2 of the two electromagnets A and B are connected to a controllable current supply 8, so that, corresponding to the predetermined operating conditions, the armature 4 can be moved back and forth between the two electromagnets A and B by way of a control device, not shown in detail.

The braking coils 3.1 and 3.2 at the two electromagnets A and B are designed with their own switching elements 10.1 and 10.2, as closed circuits 9.1 and 9.2, which circuits can be opened and closed by a control device for the current supply 8 or by an additional control device in the current supply 8.

As described above in conjunction with FIGS. 1 and 2, the switching elements 10.1 and 10.2 are actuated such that, shortly before the impact of the armature 4 at the respective pole surface 12, the switching element is closed and the respective braking coil is activated.

FIG. 3 shows a possibility to affect the switching position of the switching elements 10.1 and 10.2 by the provision of motion or position sensors 14.1 and 14.2 which detect the approach of the armature 4 toward the associated pole surface 12, and by means of a control that, for example, can be integrated into the current supply 8.

Instead of the described motion and/or position sensors 14.1, 14.2 14 acting, for example, inductively and disposed in corresponding positions with respect to the pole surface 12, it is also provide a sensor that detects the change in the magnetic flux as the armature approaches the pole surface, so that a change in the magnetic flux by a predeterminable value triggers a control signal, by means of which the circuit 9 is closed via the switching element 10, and the action of the braking coil is initiated.

In the circuitry explained in conjunction with FIG. 2, specifically the course of the current supply of the operating magnets, and in the circuitry described in conjunction with FIG. 3, with the use of separate sensors, the arrangement can be such that the switching element 10 is re-opened when the current in the circuit 9 returns to zero or to predetermined, lower threshold value that is higher than zero.

The changes in voltage occurring in the braking coil 2 as a function of the armature movement, and/or the changes in current occurring when the switching element 10 is closed, can be used simultaneously for recognizing the armature movement within close range of the pole surface 12. Hence, for example, the drop in the current change to zero in the circuit 9 can serve as a recognition of the impact of the armature at the pole surface 12. The voltage course (and, when the switching element 10 is closed, also the current course) induced in the braking coil during the holding period $t_H$ by the cycling of the current can be used to recognized a contacting of the armature at the pole surface.

If the switching element 10 is also kept closed during the holding period tH (FIG. 2), an increase in the current during or at the end of the holding period can be used as an indication of the release of the armature from the pole surface 12.

It is to be understood that the current-course diagram in FIG. 2 also applies for the electromagnets 2.1 and 2.2 in the embodiment of FIG. 3.

I claim:

1. An electromagnetic actuator comprising (a) an electromagnet having (1) a yoke;

(2) an operating coil supported by said yoke and connectable to a controllable current supply for effecting a current flow through said operating coil; and (3) a pole face;

(b) an armature movable from a first position remote from said pole face to a second, pole face-engaging position in response to a first electromagnetic force generated by a current flow through said operating coil;

(c) a resetting spring coupled to said armature and opposing said first electromagnetic force;

(d) a braking coil supported by said yoke;

(e) a switching element having open and closed states;

(f) a circuit formed of said braking coil and said switching element; said circuit being closed in said closed state of said switching element and being open in said open state of said switching element; and (g) switch control means responsive at least indirectly to a distance of said armature from said pole face during motion of said armature toward said pole face for placing said switching element into said closed state when said armature is at a given distance from said pole face to close said circuit for producing a second electromagnetic force opposing said first electromagnetic force.

2. The electromagnetic actuator as defined in claim 1, wherein said switch control means comprises a sensor detecting a position of said armature as it approaches said pole face.

3. The electromagnetic actuator as defined in claim 1, wherein said switch control means comprises means for detecting a level of the current flowing through said operating coil for causing said switching element to be placed into said closed state when a given current level is reached.

4. The electromagnetic actuator as defined in claim 1, wherein said switch control means is incorporated in the controllable current supply.

* * * * *